United States Patent [19]

Leavesley

[11] 3,950,067

[45] Apr. 13, 1976

[54] ELECTRICAL CONNECTION MEANS

[75] Inventor: Brian Leavesley, Aspley, England

[73] Assignee: TRW Inc., Cleveland, Ohio

[22] Filed: Aug. 2, 1974

[21] Appl. No.: 494,119

[30] Foreign Application Priority Data

Aug. 8, 1973 United Kingdom ..... 37511/73

[52] U.S. Cl. ..... 339/176 MF; 339/17 F; 339/91 R

[51] Int. Cl.[2] ..... H01R 13/50

[58] Field of Search ..... 339/17 F, 91 R, 176 MF

[56] References Cited

UNITED STATES PATENTS

| | | | |
|---|---|---|---|
| 3,277,425 | 10/1966 | Marshall | 339/176 MF |
| 3,523,269 | 8/1970 | Witek | 339/91 R |
| 3,696,319 | 10/1972 | Olsson | 339/176 MF |
| 3,820,053 | 6/1974 | Champion | 339/176 MF |

*Primary Examiner*—Roy Lake
*Assistant Examiner*—Mark S. Bicks
*Attorney, Agent, or Firm*—James R. O'Connor

[57] ABSTRACT

An electrical connector arrangement for connecting selected wires of an automobile wiring harness to selected conducting paths of a flexible circuitry member which extends along the rear of the automobile instrument housing.

The connector arrangement includes (a) a tongue projecting from the housing and over which the flexible circuitry member is folded and located, and (b) a socket which is arranged to be slid over and thereby trap the flexible circuitry member folded over the tongue, the socket being retained in its operative position by releasable inter-engaging catch members, and having electrical contact members which are connected with selected harness wires and which electrically contact outwardly-facing bare parts of the selected conducting paths.

10 Claims, 5 Drawing Figures

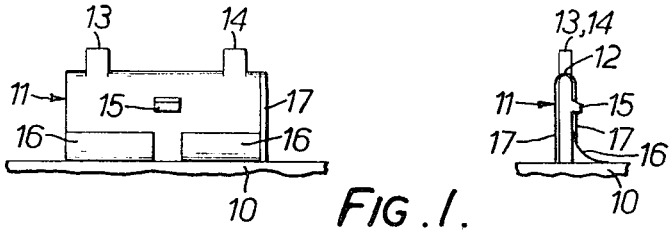
FIG. 1.
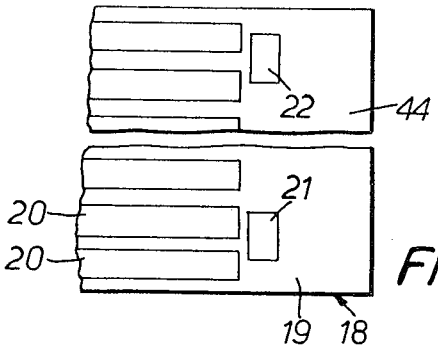
FIG. 2.
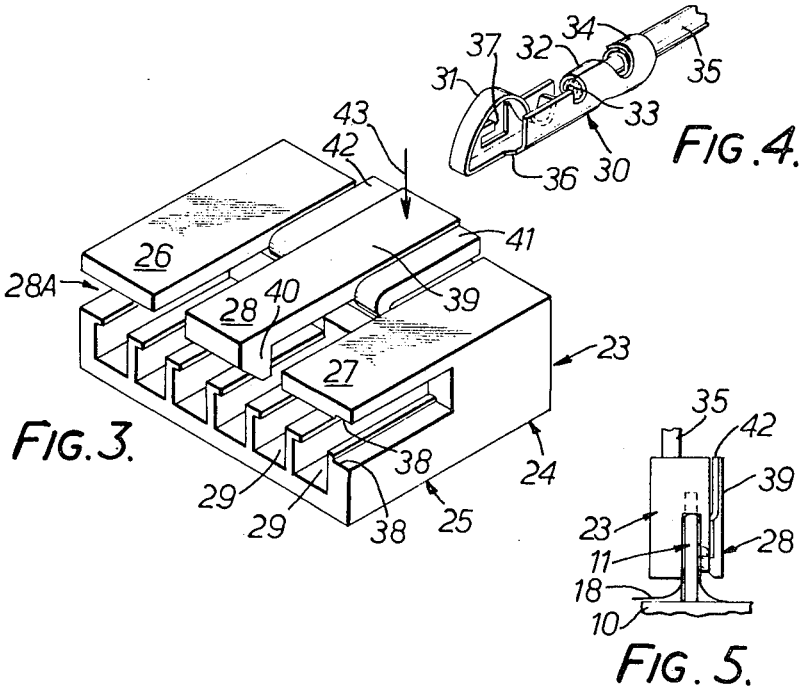
FIG. 4.
FIG. 3.
FIG. 5.

ELECTRICAL CONNECTION MEANS

This invention relates to an electrical connector for use with flexible circuitry. Such circuitry typically comprises a plurality of conducting paths (conductors) carried on a thin flexible insulating substrate, and such circuitry currently finds application in, inter alia, the automobile industry.

One important application of flexible circuitry is at the back of an automobile instrument panel, where it is used, superposed on the rear of the instrument housing, to conduct current to instruments and warning lights. Such flexible circuitry needs to be connected with wires contained in the main wiring harness of the vehicle, and for this purpose a convenient form of connector is required.

According to one feature of the present invention such an instrument housing is provided with a projecting tongue over both sides of which the flexible circuitry is carried in the form of a loop, apertures formed in the flexible circuitry being engaged on location studs which project from the tongue, preferably from the tip of the tongue, and a connector having contacts connected with the harness wiring is pressed home over the outermost surfaces of the loop of flexible circuitry and the tongue, in the manner of a clothes peg on a clothes line, whereby to cause those contacts to make sliding electrical contact with previously bared adjacent parts of the conductors carried in the flexible circuitry.

In order to prevent accidental dislodgement of the connector from the tongue and adjacent flexible circuitry, the tongue is provided with a projecting catch member with which a cooperating catch member provided on the connector is arranged to engage on pressing the connector home on the tongue.

In one preferred arrangement, the tongue is upstanding from a rear surface of the said instrument housing, and the said location studs project from the tip of the upstanding tongue.

According to another feature of the present invention, the connector has disposed along one side thereof a contact housing which houses a plurality of the said contacts spaced apart across the width of the housing for engagement with correspondingly-spaced conductors on the looped over part of the flexible circuitry, and along the other side thereof a pair of backing members disposed on either side of a central catch member, and between the said contact housing and the backing and catch members a transversely extending space dimensioned to receive the said tongue when carrying the said loop of flexible circuitry.

The said catch member is preferably resiliently hinged centrally on a body part from which the said contact housing and the backing members extend, by means of at least one U-shaped extension of the body part, which extension lies alongside and is secured to a part of the catch member.

Other features of the present invention will appear from the following description, given by way of example and with reference to the accompanying drawings, of one connector arrangement, according to the present invention, for making connection between harness wiring of a motor car and a length of flexible circuitry which carries current to instruments and warning devices on the instrument panel of the car.

In the drawings:

FIG. 1 shows front and side elevations of an upstanding tongue formed on the back of a moulded instrument housing;

FIG. 2 shows to an enlarged scale a plan view of one end of a piece of flexible circuitry ready for fixing on the upstanding tongue of FIG. 1;

FIG. 3 shows to an enlarged scale an isometric view of a connector for use on the upstanding tongue of FIG. 1;

FIG. 4 shows to an enlarged scale an isometric view of a phosphor bronze contact crimped on to the end of one wire of the wire harness of the car, ready for insertion in the connector of FIG. 3; and FIG. 5 shows a side view similar to that of FIG. 1, but with the connector disposed in its working position on the upstanding tongue.

Referring now to the FIG. 1, the back of the car instrument housing is indicated at 10. Upstanding therefrom is a tongue 11 having a rounded upper edge or ridge 12, from which project two transversely spaced location lugs 13, 14. One surface of the tongue carries, integrally formed therewith, a catch or locking member 15. At its junction with the back 10 of the instrument housing the tongue 11 is provided on one side thereof with concave fillets 16. Location ribs 17 are formed on either side of the tongue at one end thereof.

Fixed on the back 10 of the instrument housing is a run of a flexible circuitry member, see FIG. 5. One end 18 of this run is prepared in the manner shown in FIG. 2 in readiness for securing in position over the tongue 11. The flexible circuitry member comprises a thin flexible substrate 19 of an electrically insulating material which carries adherent thereto a plurality of parallel conducting paths 20. These paths are covered, except at the connection end, with a protective covering (not shown). Two location apertures 21, 22 are provided in the end part of the flexible circuitry member at positions suited to location on the location lugs 13, 14 of the tongue 11.

The end of the flexible circuitry member is carried over the tongue in the manner of a loop and is impaled on the location lugs 13, 14 which engage in the said apertures 21, 22.

A connector 23 for plugging on to the tongue and looped flexible circuitry member is shown in FIG. 3. This connector comprises a one piece moulding of an electrically insulating plastics material. From a body part 24 there extends on one side a contact housing 25 and on the other side two backing members 26, 27 disposed on either side of a resilient catch member 28. Between each backing member and the adjacent part of the contact housing is a narrow transverse space 28A of width suited to engage on the upstanding tongue 11 and associated loop of flexible circuitry member.

The contact housing 25 has formed therein a plurality of contact member receiving slots 29 which communicate with corresponding apertures extending through the said body part 24 of the connector. Disposed in these slots and apertures are contact members 30 of the form shown in FIG. 4, though these are not shown in position in FIG. 3. Each such contact member 30 has a resilient contact loop 31, conductor engaging parts 32 which are crimped on to the conducting wire stands 33 of a harness wire end, and wire restraining parts 34 which are crimped on to the insulating sleeve 35 of the harness wire. The contact member has a location shoulder 36 for limiting movement of the contact member into a contact housing slot 29 on insertion therein, and a reverse movement restraining lug 37 for engagement with a shoulder in that slot whereby to prevent withdrawal of the contact member from its working position in that slot.

One end of the connector moulding is relieved at 38 so as to enable the connector to be located by the ribs 17 provided on the upstanding tongue 11.

The resilient catch member 28 comprises a spine or arm 39 of uniform cross-section carrying at its free end a tang or locking member 40 which projects towards the said contact housing 25. The spine 39 is supported adjacent the said body part 24 by two U-shaped hinge or pivotal mounting parts 41, 42. Each of these hinge parts has one of its constituent limbs formed integrally with the said body part 24 of the connector, and the other of its constituent limbs formed integrally with the adjacent part of the spine.

The catch member normally occupies the position shown in the FIG. 3, but the part of the spine carrying the tang 40 can be caused to move away from the contact housing 25 by applying pressure to the opposite end of the spine as at the position indicated by the arrow 43. This catch member thus behaves as a centrally pivoted member which is biased to a position suitable for engaging behind the catch member 15 formed on the upstanding tongue 11.

In order to connect the conducting paths 20 at the end of the flexible circuitry member to wires in the car wiring harness, the ends of the or selected conducting paths are bared and the end of the flexible circuitry member is then looped over the upstanding tongue 11 with the location apertures 21, 22 engaged on the location lugs 13, 14 of the tongue 11, and with the bared parts of the conducting paths facing outwardly. The connector is then plugged on to the upstanding tongue so that the backing members and catch member slide over the part 44 of the said loop which carries no conducting paths, and the resilient contact loops 31, projecting from the slots 29 in the said contact housing 25, slide over and make contact with the respective bared conducting paths 20.

The connector is moved on to the tongue until the tang 40 of the catch member 28 on the connector rides over and then falls behind the catch member 15 on the upstanding tongue 11. The connector is then firmly locked in its working position, and can be removed therefrom only by applying appropriate catch releasing pressure to the catch member at its free end, i.e. as at the position of arrow 43.

In an alternative form of the electrical connector arrangement described above, the location lugs 13, 14 may be replaced, if desired, by other forms of locating and restraining means. For example, those lugs may be replaced by suitably-pointed spikes for penetrating the flexible circuitry member without the need to provide beforehand appropriately positioned location apertures therein.

Moreover, the locating lugs, spikes or other forms of self-penetrating locating devices may be positioned on the tongue 11 at any alternative convenient position.

Though in the connector arrangement described above with reference to the drawing the tongue 11 is disposed at right angles to the rear of the housing 10, if desired the tonge may be disposed at any other convenient angle to the rear of the housing. The tongue may even be disposed parallel to but offset from the rear of the housing, being carried in such a case on a member which projects from the rear of the housing 10.

Furthermore, though in the connector arrangement described above with reference to the drawing the end part of the flexible circuitry member has been engaged on the tongue 11 so as to enable electrical contact to be made with the ends of selected conducting paths, the connector arrangement may also be used to enable electrical connection to be made with selected conducting paths at other positions on the flexible circuitry member remote from the ends. In such a case the conducting paths must be arranged to avoid the locating lugs 13, 14 and the catch member 15, by suitable design of the flexible circuitry member and/or the parts 13, 14 and 15.

What we claim is:

1. Electrical connection means for enabling electrical connection to be made between selected electrical wiring conductors and selected electrically-conducting paths carried on a thin flexible electrically-insulating substrate including a tongue over which a part of such a substrate may be folded with bare parts of the selected conducting paths exposed outermost, and a one-piece electrical connection socket arranged for sliding engagement on the tongue and having gripping parts including a pair of laterally spaced limbs arranged to overlie one side of the tongue for gripping such a substrate part when folded over the tongue whereby to grip the substrate part firmly between opposing parts of the tongue and socket, the tongue also having substrate locating means for engaging the substrate and restraining it against movement relative to the tongue when the socket is pressed home into its operative position on the tongue and associated substrate part, and the socket having resilient electrical contact members for connection with the respective selected wiring conductors and having electrical contact surfaces for electrically contacting the respective bare parts of the selected conducting paths, the socket and tongue being provided with cooperating locking members for engaging one another when the socket is pressed home to its operative position and for thereafter retaining the socket in that position, one of the locking members being resiliently mounted to enable it to be disengaged from the other locking member whereby to enable the socket and tongue to be disengaged, the resiliently mounted locking member being disposed substantially centrally on the socket between the pair of limbs of the socket and the tongue-mounted locking member projecting from the same side of the tongue as that which the limbs overlie.

2. Electrical connection means according to claim 1, wherein the locking member of the socket is carried at the end of an arm which is pivoted at a position intermediate its ends on the socket and which is resiliently biased to a position in which that socket-mounted locking member engages automatically with the tongue-mounted locking member when the socket is pressed home to its operative position, the other end of the arm being capable of depression towards the socket so as to disengage the two locking members whereby to enable the socket to be withdrawn from the tongue and substrate part.

3. Electrical connection means according to claim 1, wherein the said electrical contact members are arranged to make electrical contact with the said selected conducting paths on the side of the tongue opposite the tongue-mounted locking member.

4. Electrical connection means according to claim 2, wherein the said electrical contact members are housed in contact housings disposed opposite the pair of limbs and the pivotally mounted arm.

5. Electrical connection means according to claim 2, wherein the socket comprises a moulding of an electrically insulating plastics material in which the contact housings and the pair of limbs extend from a body portion of the moulding.

6. Electrical connection means according to claim 5, wherein the said pivotally-mounted arm is formed integrally with the moulding, the arm being carried on flexible extensions of the body portion.

7. Electrical connection means according to claim 1, wherein the socket and tongue have cooperating complementary tongue and groove parts to locate the socket transversely of the tongue whereby to ensure proper electrical contact between the electrical contact members and the respective bare parts of the selected conducting parts.

8. Electrical connection means according to claim 7, wherein the said complementary tongue and groove parts comprise at least one tongue part formed at a side boundary of the tongue, and a complementary recess extending along the corresponding side boundary of the socket.

9. Electrical connection means according to claim 1, wherein the substrate locating means comprises at least one location lug which projects from the tongue and engages in a preformed aperture in the substrate part.

10. Electrical connection means according to claim 1, wherein the said tongue is connected to a panel at right angles thereto.

* * * * *